US010478874B2

(12) United States Patent
Suzuki et al.

(10) Patent No.: US 10,478,874 B2
(45) Date of Patent: Nov. 19, 2019

(54) LOCAL AIR CLEANER

(71) Applicant: KOKEN LTD., Tokyo (JP)

(72) Inventors: Taketo Suzuki, Tokyo (JP); Kozo Nitta, Tokyo (JP); Yuki Fujishiro, Tokyo (JP); Tomoyuki Kakinuma, Tokyo (JP); Takahiro Sato, Tokyo (JP)

(73) Assignee: KOKEN LTD., Tokyo (JP)

( * ) Notice: Subject to any disclaimer, the term of this patent is extended or adjusted under 35 U.S.C. 154(b) by 109 days.

(21) Appl. No.: 14/649,649

(22) PCT Filed: Dec. 3, 2013

(86) PCT No.: PCT/JP2013/082497

§ 371 (c)(1),
(2) Date: Jun. 4, 2015

(87) PCT Pub. No.: WO2014/088007

PCT Pub. Date: Jun. 12, 2014

(65) Prior Publication Data

US 2015/0306641 A1 Oct. 29, 2015

(30) Foreign Application Priority Data

Dec. 7, 2012 (JP) ..... 2012-268614

(51) Int. Cl.
*B08B 15/02* (2006.01)
*F24F 7/06* (2006.01)
*F24F 1/0071* (2019.01)

(52) U.S. Cl.
CPC ..... *B08B 15/023* (2013.01); *F24F 1/0071* (2019.02); *F24F 7/06* (2013.01)

(58) Field of Classification Search
CPC ..... B08B 15/023; F24F 3/1607; F24F 7/06; F24F 11/04; F24F 2001/0096;
(Continued)

(56) References Cited

U.S. PATENT DOCUMENTS 3,998,142 A 12/1976 Foreman et al.
4,528,898 A * 7/1985 Sharp ..... B08B 15/023 454/61
(Continued)

FOREIGN PATENT DOCUMENTS

CN 101535730 A 9/2009
EP 2 522 921 A1 11/2012
(Continued)

OTHER PUBLICATIONS

Chinese Office Action dated Dec. 19, 2016 (with translation).
(Continued)

*Primary Examiner* — Gregory L Huson
*Assistant Examiner* — Elizabeth M. May
(74) *Attorney, Agent, or Firm* — Greer Burns & Crain Ltd.

(57) ABSTRACT

The local air cleaning apparatus 1 causes a cleaned uniform air flow blown out from an air flow opening face 23 to collide with an air collision face W to flow outside an open region, so as to cause cleanliness to be higher inside a guide 3 and inside the open region than other regions. Additionally, the apparatus 1 includes at least one of a device for measuring pressures inside the guide 3 and inside a push hood 2, a device for measuring the cleanliness inside the guide 3 or of the open region, and a device for measuring a gap area between the guide 3 and the air collision face W, and, to ensure the cleanliness from a result of the measurement, controls such that a flow velocity of the cleaned uniform air flow blown out from the air flow opening face 23 can be decelerated or accelerated.

6 Claims, 8 Drawing Sheets

(58) Field of Classification Search
CPC ..... F24F 3/161; F24F 2003/1614; F24F 2003/1639; F24F 2110/06; Y10S 55/18
USPC ..... 454/64, 58
See application file for complete search history.

(56) References Cited

U.S. PATENT DOCUMENTS

| | | | | |
|---|---|---|---|---|
| 6,632,260 | B1 * | 10/2003 | Siemers | B01D 46/0013 454/184 |
| 8,163,052 | B2 * | 4/2012 | Ono | A47B 9/00 454/56 |
| 2004/0198215 | A1 | 10/2004 | Bridenne et al. | |
| 2006/0151013 | A1 * | 7/2006 | Tsuneta | B25J 18/04 134/76 |

FOREIGN PATENT DOCUMENTS

| | | | |
|---|---|---|---|
| JP | 57-28225 | | 2/1982 |
| JP | 61-27435 | | 2/1986 |
| JP | 63-176943 | | 7/1988 |
| JP | 7-158919 | | 6/1995 |
| JP | 11-218355 | | 8/1999 |
| JP | 2008-224178 | | 9/2008 |
| JP | 2008-275266 | | 11/2008 |
| JP | 2008275266 | A * | 11/2008 |
| JP | 2011-202945 | | 10/2011 |
| JP | 2013-36729 | | 2/2013 |
| WO | WO 02/093082 | A1 | 11/2002 |

OTHER PUBLICATIONS

Int'l. Search Report issued in Int'l. App. No. PCT/JP2013/082497, dated Jan. 7, 2014.
Extended EP Search Report dated Oct. 13, 2016.
Taiwanese Office Action dated Oct. 19, 2016 (with translation).

* cited by examiner

| DISTANCE a (mm) | GAP AREA ($cm^2$) | FLOW VELOCITY(m/s) | POWER CON-SUMPTION(W) | CLEANLINESS (ISO CLASS) |
|---|---|---|---|---|
| 1000 | 55000 | 0. 31 | 191. 5 | CLASS 1 |
| 9 | 495 | 0. 06 | 57. 5 | CLASS 1 |
| 15 | 825 | 0. 08 | 62. 0 | CLASS 1 |
| 22 | 1210 | 0. 09 | 65. 9 | CLASS 1 |

LOCAL AIR CLEANER

This is a National Phase Application filed under 35 U.S.C. § 371, of International Application No. PCT/JP2013/082497, filed Dec. 3, 2013.

TECHNICAL FIELD

The present disclosure relates to a local air cleaning apparatus.

BACKGROUND ART

Conventionally, a clean bench is often used as an apparatus for improving air cleanliness of a local work space. In a typical clean bench, on only a front side of a working table is provided an opening for work, and sides thereof other than the front side form an enclosure in order to maintain cleanliness. In such a clean bench, a clean air blowing outlet is arranged within the enclosure, and a worker puts his or her hands therein from the front opening for work and then performs the work.

However, the opening for work in the clean bench is narrow. Accordingly, there is a problem in terms of workability when workers perform assembly work of a precision instrument or the like. In addition, as in a production line, when work involves transfer of manufactured products or manufactured components, procedures such as arranging the entire line in the clean room have been taken. However, this leads to a problem with large-scale equipment.

Thus, a local air cleaning apparatus has been proposed in which air flow opening faces of a pair of push hoods that can blow out a uniform flow of cleaned air are arranged opposite to each other to cause air flows from the each air flow opening face to collide with each other, thereby being able to make a region between the pair of push hoods a clean air space having a higher level of cleanliness than in other regions (Patent Literature 1).

CITATION LIST

Patent Literature

Patent Literature 1: Unexamined Japanese Patent Application Kokai Publication No. 2008-275266

SUMMARY OF INVENTION

Technical Problem

Meanwhile, although a local air cleaning apparatus can make a work space a clean air space in a short time, depending on the worker, he or she may desire to maintain an inside of the work space constantly at a high level of cleanliness even during a time when he or she is off work. In such a case, when the worker is not working in the work space, power consumption of the local air cleaning apparatus is desired to be reduced as much as possible.

The present disclosure has been accomplished in view of the above circumstances. It is an objective of the present disclosure to provide a local air cleaning apparatus that can reduce power consumption while maintaining a clean air space at a high level of cleanliness.

Solution to Problem

In order to achieve the above objective, a local air cleaning apparatus according to a first aspect of the present disclosure includes:

a push hood including an air flow opening face that blows out a cleaned uniform air flow; and a guide provided on a side of the push hood having the air flow opening face and extending from the side thereof having the air flow opening face to a downstream side of the uniform air flow to form an opening face at an end portion of the downstream side, in which the push hood is arranged such that the cleaned uniform air flow blown out from the air flow opening face passes through inside the guide and then collides with an air collision face on a downstream side of the opening face of the guide; the opening face of the guide is spaced apart from and opposite to the air collision face to form an open region between the opening face of the guide and the air collision face; and the cleaned uniform air flow blown out from the air flow opening face collides with the air collision face to flow outside the open region, so as to cause cleanliness to be higher inside the guide and inside the open region than other regions, wherein the local cleaning apparatus includes at least one of a device for measuring pressures inside the guide and inside the push hood, a device for measuring the cleanliness inside the guide or of the open region, and a device for measuring a gap area between the guide and the air collision face; and to ensure the cleanliness from a result of the measurement, the local cleaning apparatus controls such that a flow velocity of the cleaned uniform air flow blown out from the air flow opening face can be decelerated or accelerated.

A local air cleaning apparatus according to a second aspect of the present disclosure includes:

a pair of push hoods each including an air flow opening face that blows out a cleaned uniform air flow; and a guide provided on a side of each of the pair of push hoods having the air flow opening face side and extending from the side of each of the pair thereof having the air flow opening face to a downstream side of the uniform air flow to form an opening face at an end portion of the downstream side, in which the opening faces of the pair of guides are spaced apart from and opposite to each other to form an open region between the opening faces of the each guide; and the cleaned uniform air flows blown out from the each air flow opening face collide with each other inside the open region to flow outside the open region, so as to cause cleanliness to be higher inside the guides and inside the open region than other regions, wherein the local air cleaning apparatus includes at least one of a device for measuring pressures inside the guides and the push hoods, a device for measuring the cleanliness inside the guides or of the open region, and a device for measuring a gap area between the opening faces of the guides; and to ensure the cleanliness from a result of the measurement, the local air cleaning apparatus controls such that a flow velocity of the cleaned uniform air flows blown out from the air flow opening faces can be decelerated or accelerated.

A local air cleaning apparatus according to a third aspect of the present disclosure includes:

a pair of push hoods each including an air flow opening face that blows out a cleaned uniform air flow; and a guide provided on a side of one of the pair of push hoods having the air flow opening face and extending from the side of one of the pair thereof having the air flow opening face to a downstream side of the uniform air flow to form an opening face at an end portion of the downstream side, in which the opening face of the guide is spaced apart from and opposite to the air flow opening face of the push hood not provided with the guide to form an open region between the opening face of the guide and the air flow opening face of the push hood not provided with the guide; and the cleaned uniform air flows blown out from the each air flow opening face collide with each other inside the open region to flown outside the open region, so as to cause cleanliness to be higher inside the guide and inside the open region than other regions, wherein the local air cleaning apparatus includes at least one of a device for measuring pressures inside the guide and inside the push hoods, a device for measuring the cleanliness inside the guide or of the open region, and a device for measuring a gap area between the opening face of the guide and the push hood not provided with the guide; and to ensure the cleanliness from a result of the measurement, the local air cleaning apparatus controls such that a flow velocity of the cleaned uniform air flows blown out from the air flow opening faces can be decelerated or accelerated.

The guide may include a moving portion capable of changing a guide length. In this case, a distance between the opening face of the guide and the air collision face may be shortened by moving the moving portion to increase the guide length.

Advantageous Effects of Invention

The present disclosure allows power consumption to be reduced while maintaining a clean air space at a high level of cleanliness.

DESCRIPTION OF EMBODIMENTS

Figure 1:
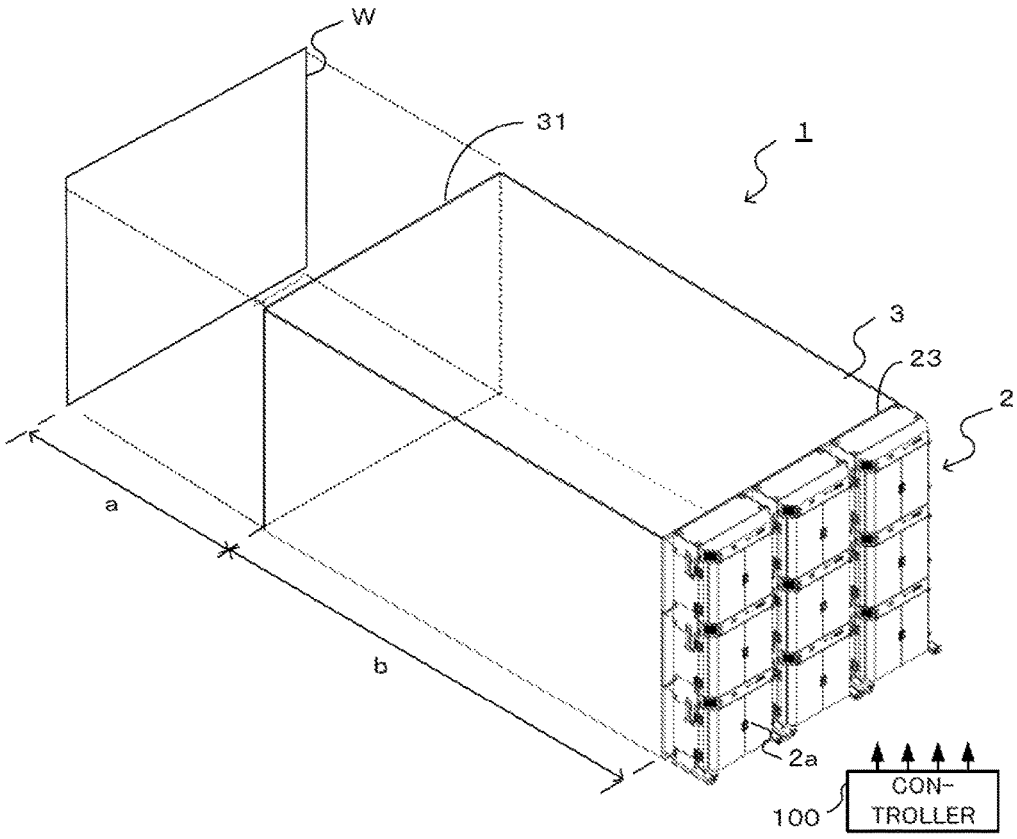
FIG. 1 is a diagram depicting a local air cleaning apparatus according to an embodiment of the present disclosure.

Hereinafter, a description will be given of a local air cleaning apparatus according to the present disclosure, with reference to the drawings. FIG. 1 is a diagram depicting an example of a local air cleaning apparatus according to an embodiment of the present disclosure.

As depicted in FIG. 1, a local air cleaning apparatus 1 of the present disclosure includes a push hood 2 arranged so as to face an air collision face W such as a wall or a partition, a guide 3 provided on the push hood 2, and a controller 100 that controls each section of the apparatus.

The push hood 2 can be any push hood as long as the push hood has a mechanism that blows out a cleaned uniform air flow. For the push hood 2, there can be employed a structure in which a cleaning filter is incorporated in a basic push hood structure conventionally used in push-pull ventilators.

The terms uniform air flow and uniform flow used herein have the same meaning as uniform flow described in "Industrial Ventilation" by Taro Hayashi (1982, published by the Society of Heating, Air-Conditioning and Sanitary Engineers of Japan,) and refer to a flow having a breeze velocity that is uniformly continuous and causes no large whirling portion. However, the present disclosure does not intend to provide an air blowout apparatus whose air flow velocity and velocity distribution is strictly specified. Regarding the uniform air flow, for example, variation in velocity distribution in a state where there are no obstacles is preferably within ±50%, and furthermore within ±30%, with respect to an average value of the variation.

The push hood 2 is arranged such that the air flow opening face 23 thereof opposes the air collision face W such as a wall. Herein, a meaning of the phrase, "the air flow opening face 23 thereof opposes the air collision face W" includes not only a state where the air flow opening face 23 of the push food 2 and the air collision face W oppose in parallel to each other, but also, for example, a state where the air flow opening face 23 of the push food 2 and the air collision face W are slightly inclined from each other. As for the inclination between the air flow opening face 23 of the push hood 2 and the air collision face W, an angle formed by the air flow opening face 23 and the air collision face W is preferably within a range of about 30 degrees.

Figure 2:
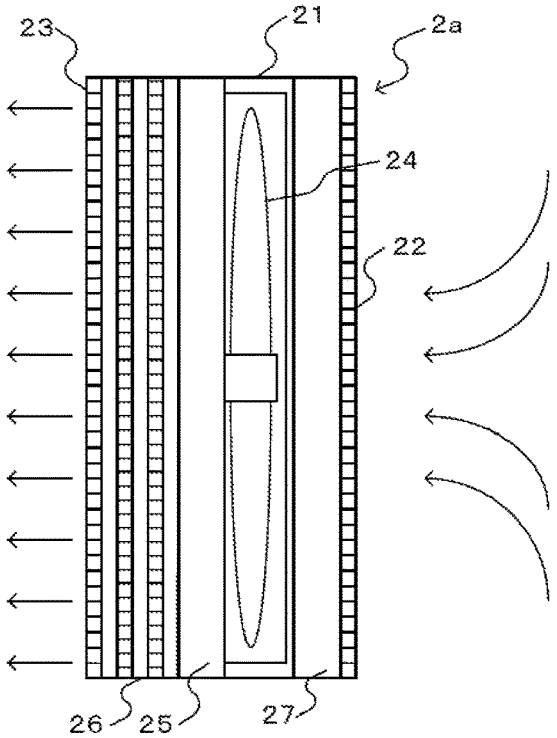
FIG. 2 is a diagram depicting a structure of a push hood.

In the push hood 2 of the present embodiment, each of nine (longitudinal three pieces x transversal three pieces) push hoods is connected to each other by a connection tool such that the air flow opening faces thereof are oriented in the same direction and short sides and long sides, respectively, of the push hoods are arranged adjacent to each other. FIG. 2 depicts a structure of one push hood 2*a*. In addition, structures of the other connected push hoods 2 are also basically the same as the structure thereof.

As depicted in FIG. 2, a housing 21 of the push hood 2*a* is formed into a substantially rectangular parallelepiped shape, and an air flow suction face 22 is formed on one surface of the housing 21. The air flow suction face 22 comprises, for example, a face where a plurality of holes are formed on an entire part of the one surface of the housing 21. The air flow suction face 22 takes in outside air or room air that is ambient air outside the push hood 2*a* through the holes. In addition, an air blowout face (an air flow opening face) 23 is formed on an other surface of the housing 21 opposing the air flow suction face 22. The air flow opening face 23 comprises, for example, a face where a plurality of holes are formed on an entire part of the one surface of the housing 21. In the air flow opening face 23, a uniform air flow of clean air formed in the push hood 2*a* is blown out of the push hood 2*a* through the holes. A size of the air flow opening face 23 of the push hood 2*a* is not particularly limited, but is, for example, 1050×850 mm.

In the housing 21 are arranged an air blowing mechanism 24, a high performance filter 25, and a rectification mechanism 26.

The air blowing mechanism 24 is arranged on the side of the housing 21 where the air flow suction face 22 is located. The air blowing mechanism 24 comprises a fan 125 or the like for blowing out air. The air blowing mechanism 24 takes in outside air or room air that is ambient air of the push hood 2*a* from the air flow suction face 22 and blows out an air flow from the air flow opening face 23. As will be described later, the fan 125 is connected to the controller 100 to be able to change a flow velocity of the air flow blown out from the air flow opening face 23.

The high performance filter 25 is arranged between the air blowing mechanism 24 and the rectification mechanism 26. The high performance filter 24 comprises a high performance filter in accordance with the level of cleaning, such as a HEPA filter (High Efficiency Particulate Air Filter) or an ULPA filter (Ultra Low Penetration Air Filter) for filtrating ambient air taken in. The high performance filter 25 cleans the ambient air taken in by the air blowing mechanism 24 to a desired cleanliness level. The clean air cleaned to the desired cleanliness level by the high performance filter 25 is sent to the rectification mechanism 26 by the air blowing mechanism 24.

The rectification mechanism 26 is arranged between the high performance filter 25 and the air flow opening face 23. The rectification mechanism 26 is provided with a not-shown air resistor and formed with a punching plate, a net member, or the like. The rectification mechanism 26 corrects (rectifies) blown air sent from the higher performance filter 25 and having an amount of aeration biased with respect to an entire part of the air flow opening face 23 into a uniformized air flow (a uniform air flow) having an amount of aeration unbiased with respect to the entire part of the air flow opening face 23. The uniform air flow obtained by the rectification is blown out by the air blowing mechanism 24 from the entire part of the air flow opening face 23 to the outside of the push hood 2.

In addition, as depicted in FIG. 2, the push hood 2*a* is preferably provided with a pre-filter 27 arranged between the air flow suction face 22 and the air blowing mechanism 24 in the housing 21. An example of the pre-filter 27 may be a medium performance filter. The arrangement of the pre-filter 27 between the air flow suction face 22 and the air blowing mechanism 24 allows removal of relatively large dust particles contained in the ambient air sucked into the housing 21 through the air flow suction face 22. In this way, the dust particles can be removed in multiple stages according to the size of the dust particles contained in the ambient air. Accordingly, the high performance filter 25, which tends to cause clogging or the like, can maintain performance thereof for a long period.

In the push hood 2*a* thus configured, the ambient air taken in by the air blowing mechanism 24 is cleaned to a desired cleanliness level by the pre-filter 27 and the high performance filter 25. Then, the clean air subjected to the cleaning is rectified into a uniform air flow by the rectification mechanism 26. The uniform air flow thus cleaned is blown to outside from the entire part of the air flow opening face 23 in a direction substantially perpentdicular to the air flow opening face 23 of the push hood 2*a*.

One end of the guide 3 is provided on a side of the push hood 2 having the air flow opening face 23. In addition, the guide 3 is provided on the air flow opening face 23 and formed in such a manner as to extend therefrom to a downstream side of the uniform air flow blown out from the air flow opening face 23 to cover an outer peripheral outline portion of the air flow opening face 23. For example, when the air flow opening face 23 has a quadrangular shape, the guide 3 is formed to be extended in such a manner as to have a U-letter cross-sectional shape. With an open side of the U-letter shape and a floor surface, the guide 3 is brought into a state of enclosing the outer peripheral outline portion in a blowout direction of the uniform air flow and surrounding, like a tunnel, a periphery of an air flow in parallel to a stream of the uniform air flow blown out therefrom.

The guide 3 can be formed using an arbitrary material as long as an air flow blown out from the opening face 31 thereof can maintain the state of the cleaned uniform air flow blown out from the air flow opening face 23. In addition, the guide 3 does not necessarily have to completely cover an entire periphery of the uniform air flow as long as the state of the cleaned uniform air flow blown out from the air flow opening face 23 can be maintained. For example, the guide 3 may have a hole or a slit formed in a part thereof.

Preferably, the opening face 31 is formed so as to have substantially the same shape as the air flow opening face 23. The reason for that is that forming the opening face 31 and the air flow opening face 23 in substantially the same shape allows the state of the uniform air flow blown out from the air flow opening face 23 to be easily maintained on the opening face 31.

A length b of the guide 3 is made to be a length that allows a space having a desired size to be formed between the air flow opening face 23 and the air collision face W and allows the opening face 31 and the air collision face W to be arranged so as to be able to face each other in a state of being spaced apart from each other by a predetermined distance a. Then, the guide 3 is arranged such that the opening face 31 and the air collision face W face each other in the state of being spaced apart from each other by the predetermined distance a therebetween. Thus, since the opening face 31 is arranged so as to oppose the air collision face W in the state of being spaced apart therefrom, an open region is formed between the opening face 31 and the air collision face W. In this state, the uniform air flow blown out from the air flow opening face 23 of the push hood 2 (the opening face 31) collides with the air collision face W to change a flowing direction thereof. For example, when the opening face 31 is opposed in parallel to a wall, the uniform air flow collides with the air collision face W and then exhibits a behavior of changing the direction of the flow substantially perpendicularly. Then, the uniform air flow having collided with the air collision face W and having changed the flow direction thereof is discharged from the open region between the opening face 31 and the air collision face W to outside a space between the air flow opening face 23 and the air collision face W. As a result, a clean space can be obtained in the region between the air flow opening face 23 and the air collision face W.

Figure 3:
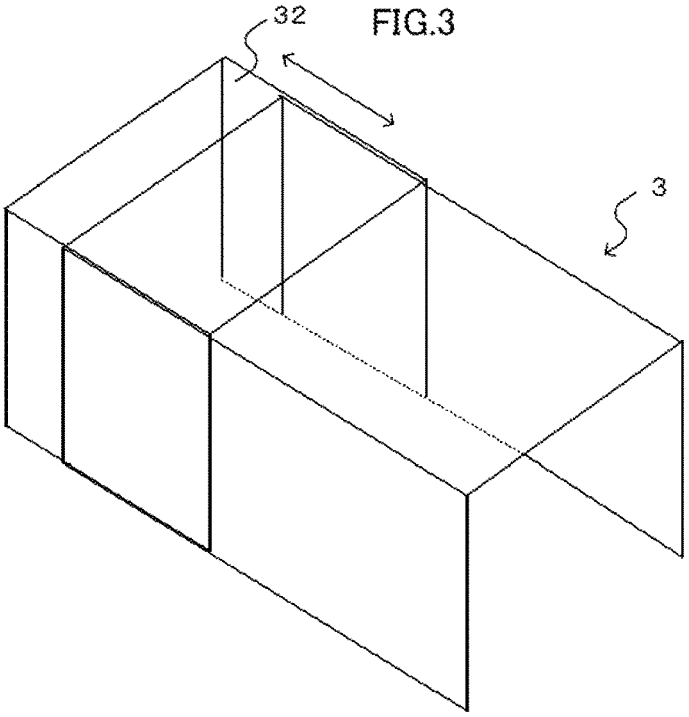
FIG. 3 is a diagram depicting a structure of a guide.

In addition, the local air cleaning apparatus 1 of the present disclosure is provided with a distance adjustment mechanism that can adjust the distance a between the opening face 31 and the air collision face W. In the present embodiment, as depicted in FIG. 3, the guide 3 is provided with a moving portion 32 that is formed so as to cover a side of the guide 3 having the opening face 31 and is capable of changing the length b of the guide 3. As will be described later, the moving portion 32 is connected to the moving mechanism 127, and the moving mechanism moves the moving portion 32 to change the length b of the guide 3, thereby being able to adjust the distance a between the opening face 31 and the air collision face W.

In addition, the local air cleaning apparatus 1 of the present disclosure includes at least one of a device for measuring pressures inside the guide 3 and inside the push hood 2, a device for measuring cleanliness inside the guide 3 or the open region, and a device for measuring a gap area between the guide 3 and the air collision face W. Then, from the measurement result, the local air cleaning apparatus 1 controls in order to ensure cleanliness such that a flow velocity of the cleaned uniform air flow blown out from the air flow opening face 23 can be decelerated or accelerated.

Examples of the device for measuring pressures inside the guide 3 and inside the push hood 2 include a pressure gauge 123, which will be described later. Examples of the device for measuring the cleanliness of the open region include a particle counter capable of measuring a number of dust particles. Examples of the device for measuring the gap area between the guide 3 and the air collision face W include a distance sensor.

Herein, the gap area refers to any one of the following areas:

(1) An area of three faces open between the opening face 31 of the guide 3 and the air collision face W (an area of four faces if there is no floor);

(2) An area of three faces open between the opening face 31 of the guide 3 and the push hold 2 not provided with the guide 3 (an area of four faces if there is no floor); and (3) An area of three faces open between opening faces 31 of guides 3 (an area of four faces if there is no floor).

Examples of a method for measuring such a gap area include a method of simply calculating from the distance sensor and lengths of sides of the guide 3 and a method of calculating from a blown-out air velocity in the gap and a volume of air blown out from the push hood 2.

Figure 4:
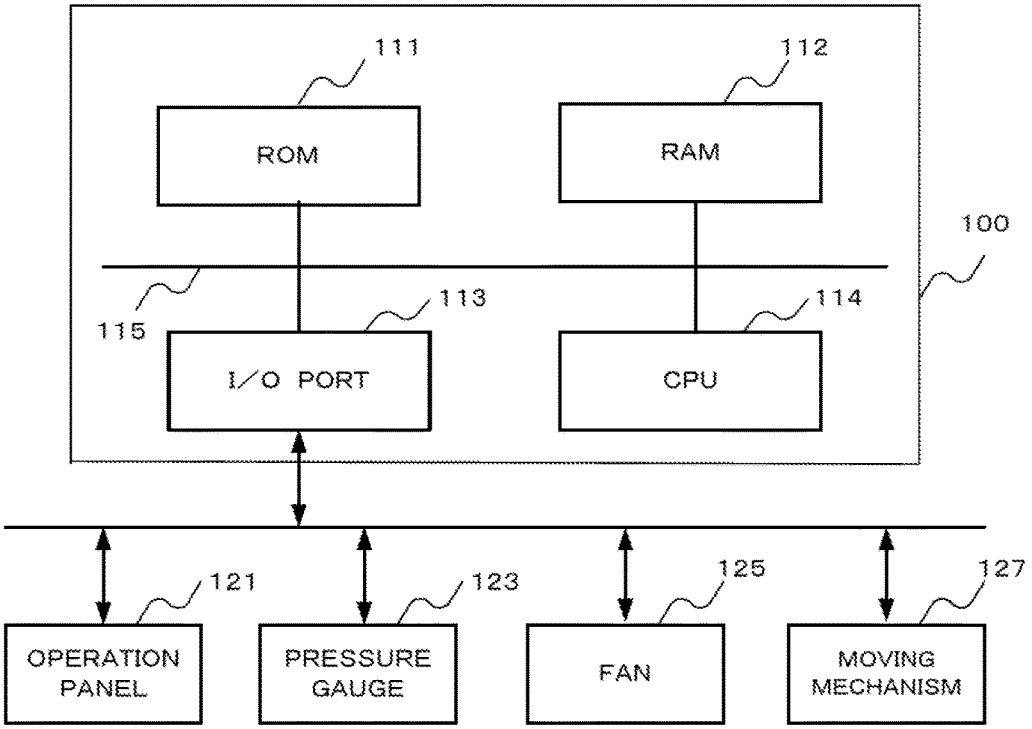
FIG. 4 is a diagram depicting a structure of a controller.

The controller 100 controls each device section of the local air cleaning apparatus 1. FIG. 4 depicts a structure of the controller 100. As depicted in FIG. 4, an operation panel 121, the pressure gauge 123, the fan 125, the moving mechanism 127, and the like are connected to the controller 100.

The operation panel 121 includes a display screen and operation buttons to send an operation instruction of an operator to the controller 100. In addition, the operation panel 121 displays various kinds of information from the controller 100 on the display screen.

The pressure gauge 123 is incorporated, for example, in the push hood 2, and one of measurement ports thereof is arranged inside the guide 3 and the other one thereof is arranged inside the push hood 2. The pressure gauge 123 measures an inner pressure inside the guide 3 and an inner pressure inside the push hood 2 to notify a pressure difference therebetween to the controller 100.

The fan 125 controls a flow velocity of an air flow blown out from the air flow opening face 23 to have an amount instructed by the controller 100.

The moving mechanism 127 is connected to the moving portion 32 to move the moving portion 32 so as to set the length b of the guide 3 to a length instructed by the controller 100. In addition, the moving mechanism 127 includes a sensor or the like for measuring a position of the moving portion 32 to notify the position of the moving portion 32 (the length b of the guide 3) to the controller 100.

The controller 100 comprises a ROM (read only memory) 111, a RAM (random access memory) 112, an I/O port (input/output port) 113, a CPU (central processing unit) 114, and a bus 115 for connecting these elements to each other.

The ROM 111 comprises an EEPROM (electrically erasable programmable read only memory), a flash memory, a hard disk, or the like, and is a storage medium for storing an operation program of the CPU 114 and the like. The RAM 112 functions as a work area of the CPU 114 or the like.

The I/O port 113 is connected to the operation panel 121, the pressure gauge 123, the fan 125, the moving mechanism 127, and the like to control input/output of data and signals.

The CPU 114 forms a core of the controller 100 and executes a control program stored in the ROM 111 to control operation of the local air cleaning apparatus 1 according to an instruction from the operation panel 121. In other words, the CPU 114 causes the pressure gauge 123, the fan 125, and the like to specify pressure, air volume, gap air velocity, contaminant concentration, and the like inside the guide 3, and based on the data, outputs a control signal or the like to the fan 125 and the like to control the operation of the local air cleaning apparatus 1.

The bus 115 conveys information between the respective sections.

Figure 5:
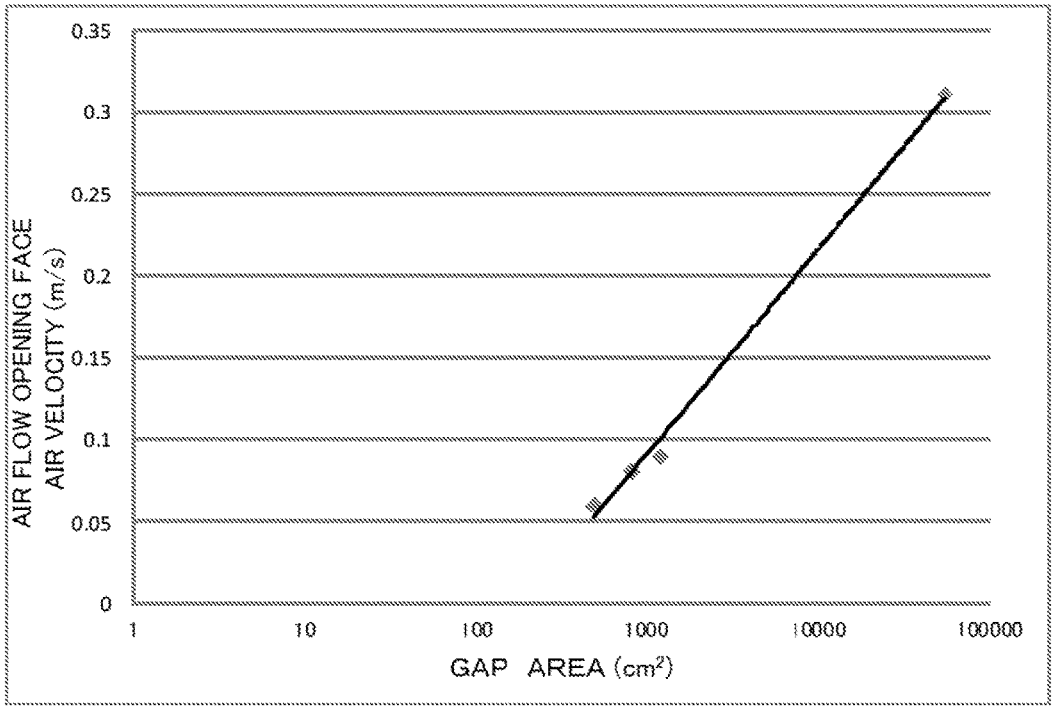
FIG. 5 is a diagram depicting a relationship between wind velocity of air flow blown out from an air flow opening face and gap area.

In addition, the controller 100 stores a model indicating a relationship between air velocity (flow velocity) of blowout from the air flow opening face 23 and gap area, as depicted in FIG. 5. This model is a model that indicates a relationship between gap area and flow velocity of a cleaned uniform air flow blown out from the air flow opening face 23 in a state where cleanliness is ensured, and which is a model that allows calculation of a flow velocity of the air flow blown out from the air flow opening face 23 that can ensure cleanliness when the gap area is changed.

Next, a description will be given of operation of the local air cleaning apparatus 1 thus configured. In the present embodiment, the operation of the local air cleaning apparatus 1 will be illustrated by describing a change from a state where there is a worker working in a work space (normal mode) to a state where there is no worker working in the work space (energy-saving mode).

First will be described a case of starting the local air cleaning apparatus 1 in the normal mode. For example, when a worker operates the operation panel 121 to select start (normal mode start) of the local air cleaning apparatus 1, the CPU 114 controls the fan 125 (drives the fan 125 at a predetermined number of rotations) to cause the fan 125 to suck ambient air near the air flow suction face 22. The ambient air thus sucked is cleaned by the pre-filter 27 and the high performance filter 25 to obtain clean air having a desired cleanliness level. Then, the clean air obtained by the cleaning is rectified into a uniform air flow by the rectification mechanism 26, and the cleaned uniform air flow is blown out to the guide 3 from the entire part of the air flow opening face 23.

Figure 6:
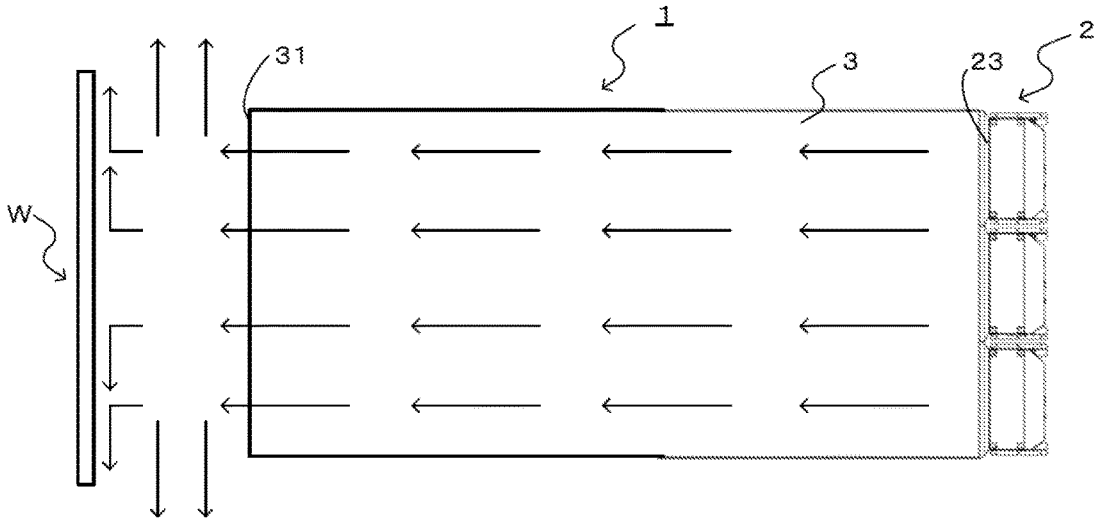
FIG. 6 is a diagram for illustrating a flow of air in a normal mode.

The cleaned uniform air flow blown out to the guide 3 passes through the guide 3 to be blown out from the opening face 31 while maintaining the state of the uniform air flow, and collides with the air collision face W. The air flow having collided flows out from the open region between the opening face 31 and the air collision face W to outside the region between the air flow opening face 23 and the air collision face W (outside the local air cleaning apparatus 1), as depicted in FIG. 6. As a result, the region between the air flow opening face 23 and the air collision face W (the inside of the guide 3 and the open region between the opening face 31 and the air collision face W) can be made to be a region having a higher level of cleanliness than in a region outside the local air cleaning apparatus 1.

The length b of the guide 3 (the position of the moving portion 32) in the normal mode (normal position) is notified to the CPU 114 by the moving mechanism 127.

Next will be described a case of switching the local air cleaning apparatus 1 from the normal mode to the energy-saving mode. For example, when an operator operates the operation panel 121 to select switching of the local air cleaning apparatus 1 (switching to the energy-saving mode), the CPU 114 controls the moving mechanism 127 to move the position of the moving portion 32 in the direction of the air collision face W such that the position of the moving portion 32 is changed from the normal position to a position thereof in the energy-saving mode (energy-saving position), thereby reducing the gap area.

Figure 7:
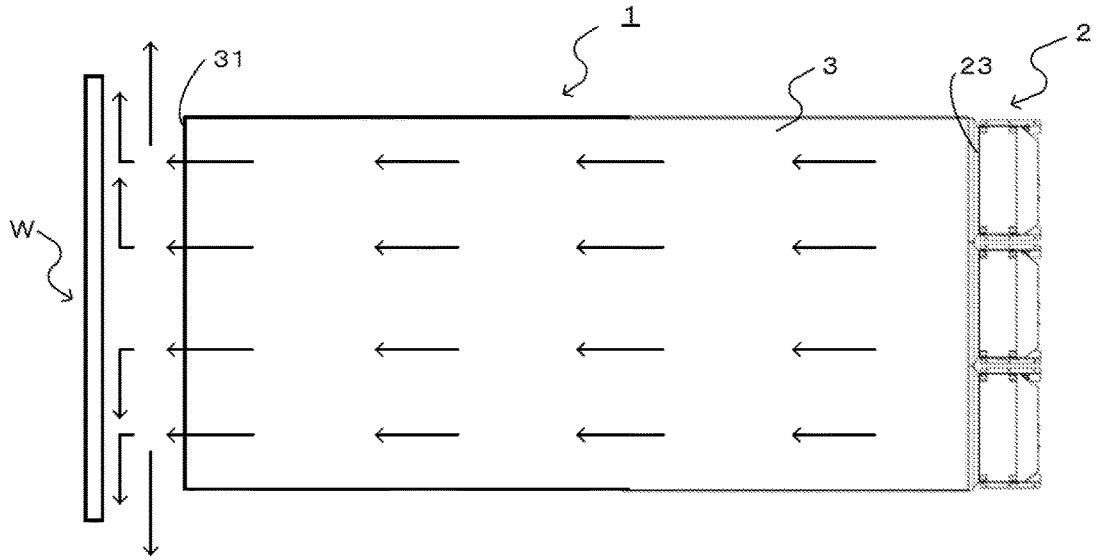
FIG. 7 is a diagram for illustrating a flow of air in an energy-saving mode.

Next, the CPU 114 causes the distance sensor to calculate the gap area in the state where the moving portion 32 is located in the energy-saving position, and using the model depicted in FIG. 5, calculates a flow velocity of blowout from the air flow opening face 23 that can ensure cleanliness. Then, the CPU 114 controls the flow velocity of blowout from the air flow opening face 23 to be a calculated flow velocity. In the state where the flow velocity of blowout from the air flow opening face 23 is controlled as described above, a flow velocity of air discharged from the open region between the opening face 31 and the air collision face W is substantially constant in the normal mode and the energy-saving mode, as depicted in FIG. 7. Thus, even in the energy-saving mode, the region between the air flow opening face 23 and the air collision face W can be maintained at a higher level of cleanliness than the region outside the local air cleaning apparatus 1. Additionally, lengths of arrows of FIGS. 6 and 7 represent a flow velocity of air. Furthermore, since the flow velocity of the air discharged from the open region between the opening face 31 and the air collision face W is substantially constant in the normal mode and the energy-saving mode, contaminants such as dust particles hardly enter from the outside into the guide 3. Accordingly, the region between the air flow opening face 23 and the air collision face W can be maintained at a higher level of cleanliness than the region outside the local air cleaning apparatus 1.

Examples of means for confirming that a high level of cleanliness is being maintained (which means being equal to the cleanliness of the normal mode) include measurement of a number of dust particles by a particle counter, maintaining the inner pressure at a constant value, and maintaining the blown-out air velocity from the gap. For example, when a numerical value of the particle counter indicates a high level value, the fan 125 is controlled so that the flow velocity from the push hood 2 increases. On the other hand, when the numerical value of the particle counter indicates a low level value, the fan 125 controls so that the flow velocity from the push hood 2 reduces. Additionally, when the blown-out air velocity from the gap reduces from a predetermined value, the fan 125 is controlled so that the flow velocity from the push hood 2 increases. On the other hand, when the blown-out air velocity from the gap increases from the predetermined value, the fan 125 is controlled so that the flow velocity from the push hood 2 reduces.

In this way, when a sufficient level of cleanliness is obtained, energy-saving operation can be performed by reducing the flow velocity. In the energy-saving mode, the number of rotation of the fan 125 is reduced as compared to the normal mode to reduce the flow velocity of the uniform air flow blown out from the air flow opening face 23, thus allowing reduction in power consumption of the local air cleaning apparatus 1.

Additionally, in the local air cleaning apparatus 1 of the present embodiment, when a hole is formed in the guide 3 and thereby the pressure inside the guide 3 is reduced, the number of rotations of the fan 125 is increased to raise the inner pressure of the guide 3, thereby maintaining cleanliness in the region between the air flow opening face 23 and the air collision face W. Furthermore, when power supply is lowered and thereby the air velocity of the cleaned uniform air flow blown out from the air flow opening face 23 is decelerated, the pressure inside the guide 3 is reduced. Accordingly, the number of rotations of the fan 125 is increased to raise the inner pressure of the guide 3, thereby maintaining cleanliness in the region between the air flow opening face 23 and the air collision face W.

As described hereinabove, in the local air cleaning apparatus 1 of the present embodiment, the position of the moving portion 32 is moved from the normal position to the energy-saving position to thereby reduce the gap area and control the flow velocity of blowout from the air flow opening face 23 to be a flow velocity that can ensure cleanliness. Thus, power consumption can be reduced while maintaining the region between the air flow opening face 23 and the air collision face W at a high level of cleanliness.

In addition, the present disclosure is not limited to the above embodiment, and various modifications and applications can be made. Hereinafter, a description will be given of other embodiments applicable to the present disclosure.

The above embodiment has described the present disclosure by exemplifying the case in which the gap area is reduced by moving the position of the moving portion 32. However, it is enough for the local air cleaning apparatus 1 of the present disclosure to have a structure capable of changing the gap area. For example, the gap area may be changed by providing a moving mechanism that allows the push hood 2 to be advanced/retracted in a direction of the air collision face W at a lower end of the push hood 2. Alternatively, the gap area may be changed by forming the guide 3 into an accordion shape. Furthermore, covering with a curtain or the like may be used as an alternative to the air collision face W. Additionally, the gap area may be changed by adding an air collision face W.

The above embodiment has described the present disclosure by exemplifying the case where the gap area is reduced and the flow velocity of blowout from the air flow opening face 23 is controlled to be a flow velocity that can ensure cleanliness. However, for example, the distance a between the opening face 31 and the air collision face W may be shortened and the flow velocity of blowout from the air flow opening face 23 may be controlled so that the pressure inside the guide 3 becomes constant, i.e, the flow velocity of blowout from the air flow opening face 23 may be controlled to be a flow velocity that can ensure cleanliness.

The above embodiment has described the present disclosure exemplified by the case where a worker operates the operation panel 121 to switch the local air cleaning apparatus 1 to the energy-saving mode. However, for example, the local air cleaning apparatus 1 may be switched to the energy-saving mode by manually moving the air collision face W. In addition, with a timer or the like, the local air cleaning apparatus 1 may be automatically switched to the energy-saving mode at night.

The above embodiment has described the present disclosure by exemplifying the case where a worker operates the operation panel 121 to switch the local air cleaning apparatus 1 to the energy-saving mode. However, for example, instead of increasing the flow velocity of the uniform air flow when a count of the particle counter increases, the air collision face W may be automatically moved toward the guide 3, so as to maintain cleanliness. Furthermore, a pressure gauge can be used instead of the particle counter. In this way, cleanliness may be maintained not only by increasing or reducing the flow velocity of the uniform air flow but also by increasing or reducing the inner pressure, increasing or reducing the gap area, or increasing or reducing the flow velocity of air blown out from the gap.

Figure 8:
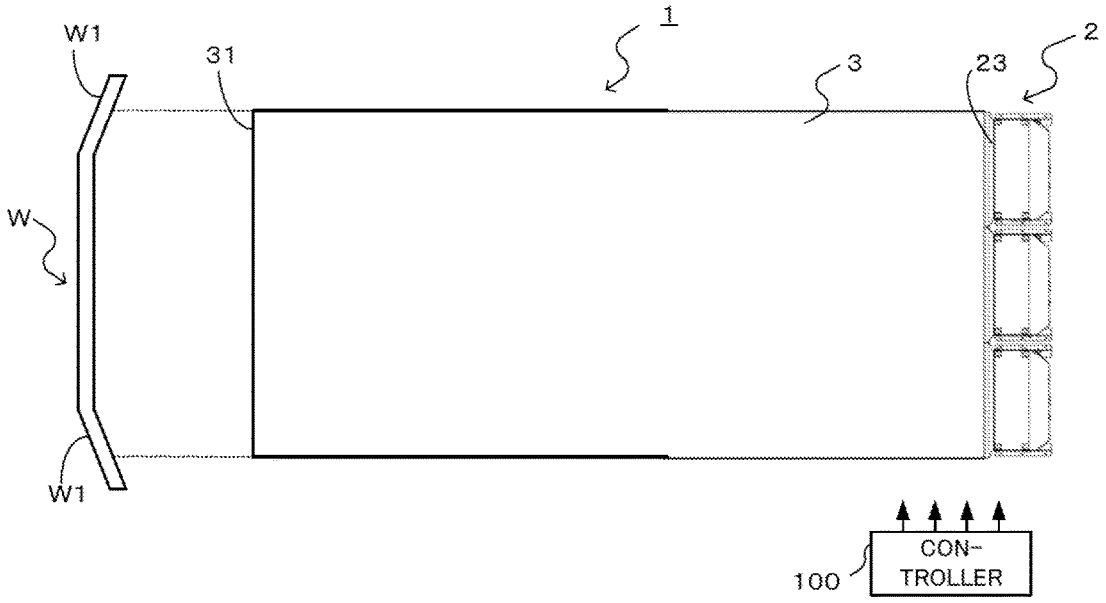
FIG. 8 is a diagram depicting another example of the local air cleaning apparatus.

While the above embodiment has described the present disclosure by exemplifying the case where the air collision face W is flat like a wall or a partition, the air collision face W is not limited thereto. For example, preferably, the air collision face W has bent portions W1 bent toward the guide 3 (the push hood 2) at end portions thereof that are close to positions opposing end portions of the opening face 31 of the guide 3, for example, at side portions of the air collision face W, as depicted in FIG. 8. Alternatively, the air collision face W may have bent portions W1 where all of an upper portion, a lower portion, and the side portions thereof are bent toward the side of the apparatus 1 having the guide 3. In addition, the bent portions W1 may have rounded corners (have roundness on corners) so as to have a gently curved surface. Providing the bent portions W1 at the air collision face W, as described above, facilitates the prevention of inflow of air from outside the open region formed between the guide 3 and the air collision face W (outside the local air cleaning apparatus 1).

Figure 9:
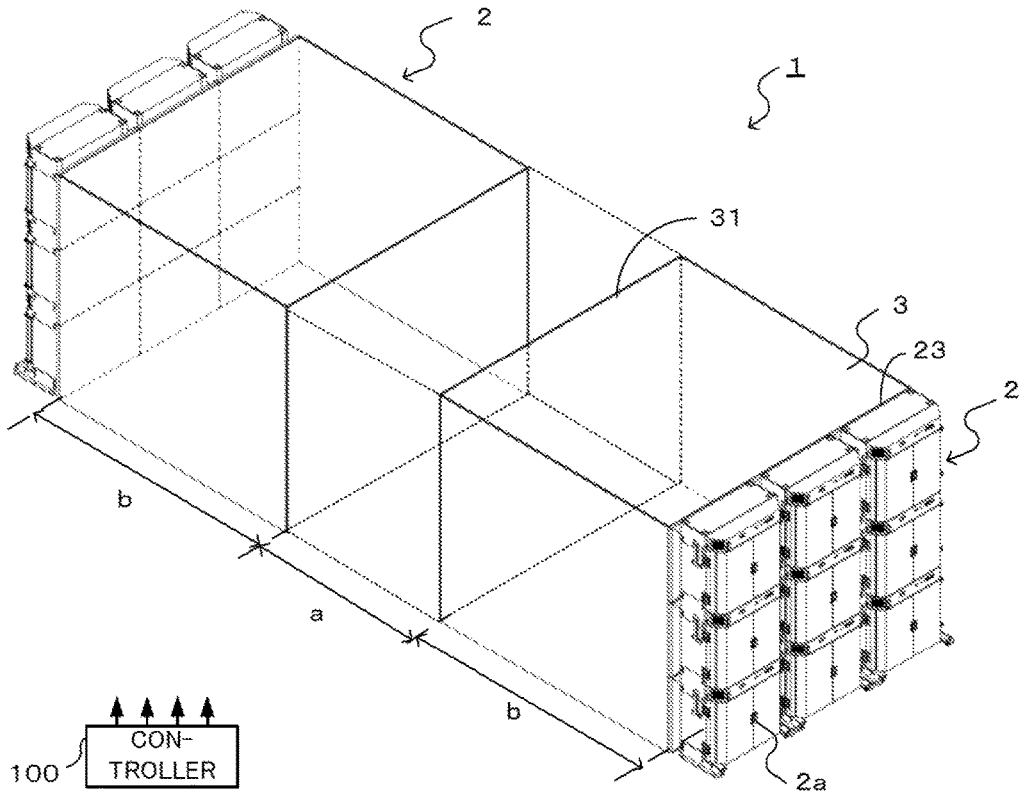
FIG. 9 is a diagram depicting another example of the local air cleaning apparatus.

The above embodiment has described the present disclosure by exemplifying the case of the local air cleaning apparatus 1 in which the push hood 2 and the air collision face W are arranged to oppose each other. However, for example, as depicted in FIG. 9, a local air cleaning apparatus 1 may be used in which a pair of push hoods 2 are arranged to oppose each other and each of the push hoods 2 is provided with a guide 3. Alternatively, a local air cleaning apparatus 1 may be used in which a pair of push hoods 2 are arranged to oppose each other and one of the push hoods 2 is provided with a guide 3.

The above embodiment has described the present disclosure by exemplifying the case of the push hood 2 in which each of the nine (longitudinal three pieces x transversal three pieces) push hoods 2*a* is connected to each other by a connection tool. However, the number of the push hoods 2*a* forming the push hood 2 may be not less than 10 or not more than 8. For example, the push hood 2 may be formed by connecting each of four (longitudinal two pieces×transversal two pieces) push hoods 2*a* to each other by a connecting tool. When connecting the push hoods 2*a* as in these examples, the push hoods 2*a* are arranged such that the air flow opening faces of the push hoods 2*a* are oriented in the same direction and short sides of the push hoods 2*a* and long sides thereof, respectively, are adjacent to each other. Alternatively, the push hood 2 may comprise a single push hood 2*a*.

EXAMPLES

Hereinafter, specific Examples of the present disclosure will be provided to further describe the present disclosure in detail.

Figures 10, 11:
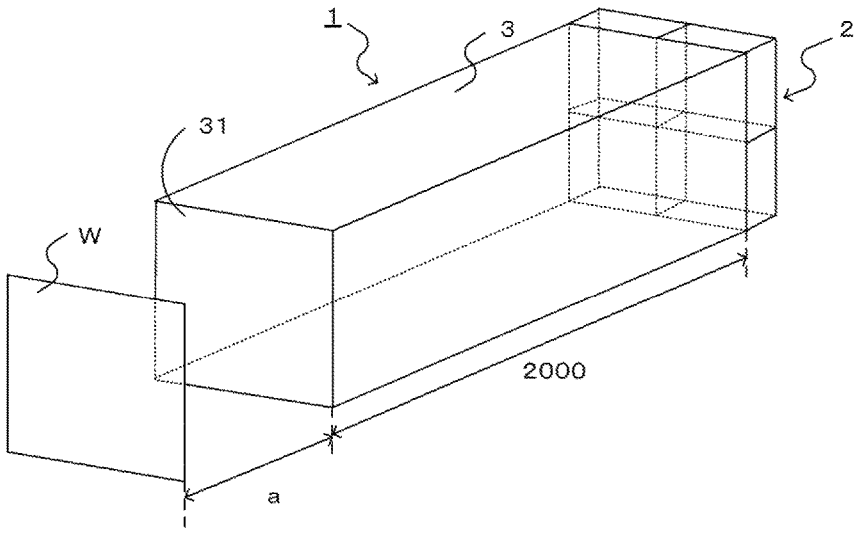
FIG. 10 is a diagram depicting a local air cleaning apparatus used in an Example.
FIG. 11 is a diagram depicting results of energy consumption and cleanliness inside the guide in cases where distance a (gap area) and flow velocity have been changed.

Using a local air cleaning apparatus 1 depicted in FIG. 10, power consumption and cleanliness inside the guide 3 were measured in a case where distance a between the opening face 31 and the air collision face W and flow velocity of blowout from the push hood 2 were changed in a state where pressure inside the guide 3 was maintained at 5 Pa. Additionally, the push hood 2 was one comprising four push hoods 2*a* (longitudinal two pieces×transversal two pieces) each having a width of 1050 mm and a height of 850 mm connected by arranging such that the air flow opening faces of the push hoods 2*a* were oriented in the same direction and short sides and long sides, respectively, of the push hoods 2*a* were adjacent to each other. The opening face 31 has a width of 2100 mm and a height of 1700 mm. Additionally, a case of a distance a of 1000 mm (gap area: 55000 $cm^2$) corresponds to the case where the local air cleaning apparatus 1 is in the above-mentioned normal mode, and cases of distances a of 9 mm (gap area: 495 $cm^2$), 15 mm (gap area: 825 $cm^2$), and 22 mm (gap area: 1210 $cm^2$) correspond to the case where the local air cleaning apparatus 1 is in the above-mentioned energy-saving mode. The measurement of cleanliness was performed by measuring the number of dust particles (pieces/CF) having a particle size of 0.3 μm using LASAIR-II manufactured by PMS Inc., and specifying ISO Class from results of the measurement. FIG. 11 depicts the results.

As depicted in FIG. 11, it was confirmed that the cleanliness inside the guide 3 in the normal mode (gap area: 55000 $cm^2$) was at a high level of cleanliness, ISO Class 1, and even in the energy-saving mode (gap areas: 495 $cm^2$, 825 $cm^2$, and 1210 $cm^2$), the cleanliness inside the guide 3 was at the high level of cleanliness, ISO Class 1. Additionally, in the energy-saving mode, power consumption was confirmed to be able to be reduced to about ⅓ of the normal mode. These results showed that power consumption can be reduced while maintaining the clean air space between the air flow opening face 23 and the air collision face W at a high level of cleanliness.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application is based on Japanese Patent Application No. 2012-268614, filed on Dec. 7, 2012, the entire contents of which, inclusive of the specification, claims, and drawings, are hereby incorporated by reference herein.

INDUSTRIAL APPLICABILITY

The present disclosure is useful for cleaning air in local work spaces.

REFERENCE SIGNS LIST

1 Local air cleaning apparatus
2, 2*a* Push hood
3 Guide
21 Housing
22 Air flow suction face
23 Air blowout face (Air flow opening face)
24 Air blowing mechanism
25 High performance filter
26 Rectification mechanism
27 Pre-filter
31 Opening face
32 Moving portion
100 controller
111 ROM
112 RAM
113 I/O port
114 CPU
115 Bus
121 Operation panel
123 Pressure gauge
125 Fan
127 Moving mechanism
W Air collision face

The invention claimed is:

1. A local air cleaning apparatus comprising:

a push hood including an air flow opening face that blows out a uniform air flow; and a guide provided on a side of the push hood covering an entire outer peripheral outline portion of the air flow opening face and extending from the side thereof having the air flow opening face to a downstream side of the uniform air flow to form an opening face at an end portion of the downstream side, wherein the push hood is arranged such that the uniform air flow blown out from the air flow opening face passes through inside the guide and then collides with an air collision face on a downstream side of the opening face of the guide; the opening face of the guide is spaced apart from and opposite to the air collision face to form an open region between the opening face of the guide and the air collision face;

the uniform air flow blown out from the air flow opening face collides with the air collision face to flow outside the open region, so as to cause a number of dust particles inside the guide and inside the open region to be lower than a number of dust particles of other regions, and wherein the local air cleaning apparatus further includes a device for measuring pressures inside the guide and inside the push hood;

the guide includes a moving portion capable of changing a position of the entire outer peripheral outline portion;

when the distance between the opening face of the guide and the air collision face decreases by moving the moving portion to lengthen the guide length, the device for measuring pressures measures the pressure rise in the guide due to the decrease of the distance, and the flow velocity of the uniform air flow is decelerated; and when the distance between the opening face of the guide and the air collision face increases by moving the moving portion to shorten the guide length, the device for measuring pressures measures the pressure drop in the guide due to the increase of the distance, and the flow velocity of the uniform air flow is accelerated.

2. A local air cleaning apparatus comprising:

a push hood including an air flow opening face that blows out a uniform air flow; and a guide provided on a side of the push hood covering an entire outer peripheral outline portion of the air flow opening face and extending from the side thereof having the air flow opening face to a downstream side of the uniform air flow to form an opening face at an end portion of the downstream side, wherein the push hood is arranged such that the uniform air flow blown out from the air flow opening face passes through inside the guide and then collides with an air collision face on a downstream side of the opening face of the guide; the opening face of the guide is spaced apart from and opposite to the air collision face to form an open region between the opening face of the guide and the air collision face;

the uniform air flow blown out from the air flow opening face collides with the air collision face to flow outside the open region, so as to cause a number of dust particles inside the guide and inside the open region to be lower than a number of dust particles of other regions, and wherein the local air cleaning apparatus further includes a device for measuring the number of dust particles inside the guide and inside the open region;

when the device for measuring the number of dust particles measures a decrease in the number of dust particles in the guide, the flow velocity of the uniform air flow is decelerated; and when the device for measuring the number of dust particles measures an increase in the number of dust particles in the guide, the flow velocity of the uniform air flow is accelerated.

3. A local air cleaning apparatus comprising:

a push hood including an air flow opening face that blows out a uniform air flow; and a guide provided on a side of the push hood covering an entire outer peripheral outline portion of the air flow opening face and extending from the side thereof having the air flow opening face to a downstream side of the uniform air flow to form an opening face at an end portion of the downstream side, wherein the push hood is arranged such that the uniform air flow blown out from the air flow opening face passes through inside the guide and then collides with an air collision face on a downstream side of the opening face of the guide; the opening face of the guide is spaced apart from and opposite to the air collision face to form an open region between the opening face of the guide and the air collision face;

the uniform air flow blown out from the air flow opening face collides with the air collision face to flow outside the open region, so as to cause a number of dust particles inside the guide and inside the open region to be lower than a number of dust particles of other regions, and wherein the local air cleaning apparatus further includes a device for measuring a gap area between the guide and the air collision face;

the guide includes a moving portion capable of changing a position of the entire outer peripheral outline portion;

when the device for measuring the gap area measures a decrease in the distance between the opening face of the guide and the air collision face by moving the moving portion to lengthen the guide length, the flow velocity of the uniform air flow is decelerated to a flow velocity that is determined according to the decreased distance; and when the device for measuring the gap area measures an increase in the distance between the opening face of the guide and the air collision face by moving the moving portion to shorten the guide length, the flow velocity of the uniform air flow is accelerated to a flow velocity that is determined according to the increased distance.

4. A local air cleaning apparatus comprising:

a pair of push hoods each including an air flow opening face that blows out a uniform air flow; and a guide provided on a side of each of the pair of push hoods covering an entire outer peripheral outline portion of the air flow opening face side and extending from the side of each of the pair thereof having the air flow opening face to a downstream side of the uniform air flow to form an opening face at an end portion of the downstream side, wherein the opening faces of the pair of guides are spaced apart from and opposite to each other to form an open region between the opening faces of the each guide;

the uniform air flow blown out from the each air flow opening face collide with each other inside the open region to flow outside the open region, so as to cause a number of dust particles inside the guide and inside the open region to be lower than a number of dust particles of other regions, and wherein the local air cleaning apparatus further includes a device for measuring pressures inside the guide and inside the push hood;

at least one of the pair of the guides includes a moving portion capable of changing a position of the entire outer peripheral outline portion;

when the distance between the opening faces of the pair of the guides decreases by moving the moving portion to lengthen the guide length, the device for measuring pressures measures the pressure rise in the guide due to the decrease of the distance, and the flow velocity of the uniform air flow is decelerated; and when the distance between the opening faces of the pair of the guides increases by moving the moving portion to shorten the guide length, the device for measuring pressures measures the pressure drop in the guide due to the increase of the distance, and the flow velocity of the uniform air flow is accelerated.

5. A local air cleaning apparatus comprising:

a pair of push hoods each including an air flow opening face that blows out a uniform air flow; and a guide provided on a side of each of the pair of push hoods covering an entire outer peripheral outline portion of the air flow opening face side and extending from the side of each of the pair thereof having the air flow opening face to a downstream side of the uniform air flow to form an opening face at an end portion of the downstream side, wherein the opening faces of the pair of guides are spaced apart from and opposite to each other to form an open region between the opening faces of the each guide;

the uniform air flow blown out from the each air flow opening face collide with each other inside the open region to flow outside the open region, so as to cause a number of dust particles inside the guide and inside the open region to be lower than a number of dust particles of other regions, and wherein the local air cleaning apparatus includes a device for measuring the number of dust particles inside the guide and inside the open region;

when the device for measuring the number of dust particles measures a decrease in the number of dust particles in the guide, the flow velocity of the uniform air flow is decelerated; and when the device for measuring the number of dust particles measures an increase in the number of dust particles in the guide, the flow velocity of the uniform air flow is accelerated.

6. A local air cleaning apparatus comprising:

a pair of push hoods each including an air flow opening face that blows out a uniform air flow; and a guide provided on a side of each of the pair of push hoods covering an entire outer peripheral outline portion of the air flow opening face side and extending from the side of each of the pair thereof having the air flow opening face to a downstream side of the uniform air flow to form an opening face at an end portion of the downstream side, wherein the opening faces of the pair of guides are spaced apart from and opposite to each other to form an open region between the opening faces of the each guide;

the uniform air flow blown out from the each air flow opening face collide with each other inside the open region to flow outside the open region, so as to cause a number of dust particles inside the guide and inside the open region to be lower than a number of dust particles of other regions, and wherein the local air cleaning apparatus further includes a device for measuring a gap area between the opening faces of the pair of the guides;

at least one of the pair of the guides includes a moving portion capable of changing a position of the entire outer peripheral outline portion;

when the device for measuring the gap area measures a decrease in the distance between the opening faces of the pair of the guides by moving the moving portion to lengthen the guide length, the flow velocity of the uniform air flow is decelerated to a flow velocity that is determined according to the decreased distance; and when the device for measuring the gap area measures an increase in the distance between the opening faces of the pair of the guides by moving the moving portion to shorten the guide length, the flow velocity of the uniform air flow is accelerated to a flow velocity that is determined according to the increased distance.

* * * * *